United States Patent [19]

Pinchot, III

[11] 4,061,104

[45] Dec. 6, 1977

[54] HYDROFOIL VESSEL

[76] Inventor: Gifford Pinchot, III, R.D. 1 No. 58A, Jordanville, N.Y. 13361

[21] Appl. No.: 693,506

[22] Filed: June 7, 1976

Related U.S. Application Data

[62] Division of Ser. No. 572,173, April 28, 1975, Pat. No. 3,996,872.

[51] Int. Cl.[2] ..... B63B 1/28

[52] U.S. Cl. ..... 114/281

[58] Field of Search ..... 114/271, 274–283, 114/123, 126; 115/19, 20, 38

[56] References Cited

U.S. PATENT DOCUMENTS

| | | | |
|---|---|---|---|
| 2,488,310 | 11/1949 | Mayer | 115/19 |
| 2,749,869 | 6/1956 | Bush | 114/280 |
| 3,124,096 | 3/1964 | Graig | 114/281 |
| 3,180,300 | 4/1965 | Singelmann | 114/282 |
| 3,237,582 | 3/1966 | Sturgeon et al. | 114/271 |
| 3,520,267 | 7/1970 | Clark | 114/280 |

*Primary Examiner*—Trygve M. Blix
*Assistant Examiner*—Stuart M. Goldstein
*Attorney, Agent, or Firm*—Lee C. Robinson, Jr.

[57] ABSTRACT

A hydrofoil vessel in which the hydrofoils comprise pairs of rotary members which are inclined in a downwardly inboard direction from opposite sides of the hull or body portion of the vessel. The rotary members have foil-shaped peripheral portions extending into the water at an acute angle with respect to the water surface and are movable both axially and angularly to achieve optimum lift consistent with the vessel's speed.

6 Claims, 14 Drawing Figures

HYDROFOIL VESSEL

This is a division of application Ser. No. 572,173 now U.S. Pat. No. 3,996,872, filed Apr. 28, 1975.

BACKGROUND OF THE INVENTION

This invention relates to water craft and amphibious vessels and more particularly to such vessels of the hydrofoil type.

In recent years hydrofoils and similar devices have become of increasing importance in the movement of vessels over the water. As is well known, hydrofoils commonly are in the form of thin generally planar structures which are suspended beneath the vessel and extend in directions substantially perpendicular to the vessel's direction of movement. The hydrofoils are usually maintained in rigid relationship to the hull of the vessel and are contoured such that at high speeds the vessel rises at least partially out of the water and rides or "planes" on the foils.

The various hydrofoil devices employed heretofore have been found to be deficient in several respects. For example, the operation of hydrofoil vessels was easily impaired by obstructions, such as floating logs and pilings, grasses, weeds, shallow water, rocks, sandbars, mudflats, and shores, and it was difficult to adapt the vessels for landing on and launching from beaches and in general for amphibious use.

Another problem resulted from the operation of the vessel in heavy seas or other conditions involving substantial wave action. The rigidly mounted hydrofoils previously employed produce rough rides or instability, and it was difficult to mount an appropriate suspension between the main portion of the vessel and the foils in an economical manner.

Still further difficulties in the operation of conventional hydrofoils resulted from excessive frictional drag due to the movement of their wetted surface area through the water, with the corresponding deleterious effect on the speed of the vessel. Attempts to reduce the wetted surface area have met with the problem that, at lower speeds, the reduced lifting effect did not adequately support the vessel. As a result the drag of the foils plus the drag of the hull was substantially more than the drag of the hull alone would have been.

In addition, there were difficulties in powering hydrofoil craft, because quite a long propeller shaft was required to keep the propeller under water when the vessel rode onto the foils. The long shaft with its attendant bearings and mounting brackets added frictional drag and contributed to the expense of constructing hydrofoil craft, with the result that they were slower, less economical of fuel, and more expensive than they otherwise would be.

Some attempts have been made to build vessels competitive with hydrofoil vessels which overcame some of the problems of hydrofoils by providing inclined rotating floats. These were not technically hydrofoil craft and did not cut through the water but behaved more like displacement hull craft with moving skins. They were limited by large wave-making drags, firstly because all displacement hulls tend to be so limited, and secondly because the submerged portion made a poor shape for a displacement hull, with the result that the shape of the "hull" formed by the portion of the float in the water necessitated the expenditure of considerable energy in pushing water sideways. In addition, rotating floats previously envisioned were severely limited by their failure to provide a sharp edge from which the water can leave the float, with the result that water was sucked up behind the floats, greatly decreasing the speed of these vessels, and actually pulling them down deeper into the water as their speed increased, an effect actually opposite to the more desirable lift provided by hydrofoil craft at speed.

A cure was sought for this in providing ridges which beat down the water when the floats were driven at a speed well in excess of that of the vessel. However, such an arrangement required too much power for optimal results, as any lifting action came primarily from the work of the engines in rotating the floats past the water, rather than from the forward motion of the vessel to support it in the manner of hydrofoils and hydroplanes. There was also the danger of sudden increases of resistance and strong downward suction in the case of power failure or power reduction when attempting to slow down from high speed, resulting in risk to craft and cargo. Furthermore, as the ridge type floats did not cut into the water in the manner of hydrofoils, they lacked purchase for rapid turns which hydrofoil craft with properly oriented foils display; and being unable to cut through waves and lacking suspension to allow the floats to rise over the waves, the water craft were buffeted at high speed with attendant instability, discomfort and danger.

SUMMARY

One general object of the invention, therefore, is to provide a new and improved vessel of the hydrofoil type.

More specifically, it is an object of this invention to provide such a vessel in which the frictional drag of the hydrofoils through the water is maintained at a minimum.

Another object of the invention is to provide a hydrofoil vessel in which the hydrofoils themselves are used as the drive mechanism for propelling the vessel. A further object of the invention is to provide a hydrofoil vessel which can move over obstructions rather than crashing into them, and which can throw off weeds, trash and other things which cling to the foils.

A still further object of the invention is to provide a hydrofoil vessel which can operate in shallow water, swamps, and mixtures of water and land, and which can land on and drive up beaches and other shores and landings.

Still another object of the invention is to provide a high speed hydrofoil vessel which is capable of turning and a high speed hydrofoil vessel which is capable of turning and maneuvering sharply, but which nonetheless can be operated safely in shallow water.

An additional object of this invention is to provide a vessel of the character indicated in which the hydrofoils are readily adjustable in accordance with the speed and the particular sea conditions encountered by the vessel.

Still another object of the invention is to provide a hydrofoil vessel utilizing comparatively simple mechanical components which is economical to manufacture and thoroughly reliable in operation.

In one illustrative embodiment of this invention, the vessel comprises a hull or body portion and at least two opposing circular members which are supported on opposite sides of the body portion. The circular members serve as hydrofoils for the vessel and extend into the water at an angle with respect to the water surface.

Particularly when the vessel is operated at its higher speeds, the peripheral portions of the circular members provide support for the vessel with a minimum of frictional drag.

In accordance with one feature of the invention, the circular members are rotatably connected to the body portion of the vessel and include thin foil-shaped peripheral portions extending into the water. The rotary motion of the circular members causes their peripheral portions to move through the water with a speed roughly matching the speed of the water past the body portion and provides a substantial reduction in the frictional drag which otherwise would occur as a result of the movement of the water over the surfaces of the members.

In accordance with another feature of the invention, in certain particularly important embodiments, the circular members are inclined in a downwardly inboard direction with respect to the body portion of the vessel, and their axes are inclined in a downwardly outboard direction. The peripheral portions of the members enter the water at an angle which advantageously lies between about ten degrees and about eighty degrees with respect to the water's surface, and in many applications between about thirty degrees and about sixty degrees. With this arrangement, there is a marked improvement in the stability of the vessel as it moves through the water, and maneuverability is greatly increased.

The stability gain of the downwardly inboard orientation over other orientations is particularly great when the rotating elements have thin foil-shaped peripheral portions or any other shape such that they produce dynamic lift in a direction substantially parallel to the axis of rotation. Downwardly inboard foils can be arranged so that the force vectors are aimed in the vicinity of the center of gravity, which is one of the simplest methods of producing roll stability in hydrofoil vessels of this type.

The downwardly inboard configuration also provides structural simplicity as it tends to centralize the attachment points of the foils. For the same reason, and because of the lesser angles involved, it is easier to arrange a drive train for downwardly inboard foils. Downwardly inboard foils conform better to the outlines of a conventional hull, lying substantially tangent to it, rather than threatening to intersect it at a ninety degree angle and necessitating foil elements so widely apart that docking is difficult. Foils in a downwardly inboard configuration can retract easily for docking, and debris and water picked up by rotary foils in the downwardly inboard configuration tend to be thrown clear of the vessel rather than at it.

The downwardly inboard configuration also is best suited to rotary foil hydrofoil vessels intended for amphibious use. The raising of the axes of rotation to a substantially horizontal orientation is all that is needed to bring the axes into the normal position to act as or accept wheels or treads. In cases in which the foils themselves serve as wheels they may be provided with rubber tips or other cushioning devices.

In accordance with a further feature of certain preferred embodiments of the invention, the circular members are connected to the vessel by a unique mounting arrangement which includes means for moving the members along their rotational axes, either actively by a control mechanism or passively by allowing the waves to move the foils along their axes against a spring and damper arrangement. This feature is particularly important in permitting the vessel to move smoothly and stably over waves.

In accordance with still another feature of certain preferred embodiments of the invention, the rotational axes of the circular members may be moved in a direction fore and aft relative to the body portion, thereby controlling the degree of "toe-in" or "toe-out" of opposing pairs of foils, and thereby also controlling the angle of attack of the foil elements with regard to the water. This will be found to be particularly advantageous in adapting the foil system to different speeds and conditions of sea and wind.

In accordance with a still further feature of several embodiments of the invention, the axis of rotation of one of the circular members may be moved in an angular direction outboard aft while the axis of the other member is moved outboard forward, thereby effecting steering of the vessel without recourse to a rudder.

In accordance with an additional feature of certain preferred embodiments of the invention, the rotational axes of the circular members are movable in an angular direction relative to the body portion of the vessel to thereby vary the angle between the peripheral portions of the members and the surface of the water. The arrangement is such that the positions of the rotary members may be readily adjusted for optimum effectiveness over a wide variety of sea conditions, vessel speeds, etc.

The present invention as well as further objects and features thereof will be understood more clearly and fully from the following detailed description of certain preferred embodiments, when read in conjunction with the accompanying drawings.

Figure 2:
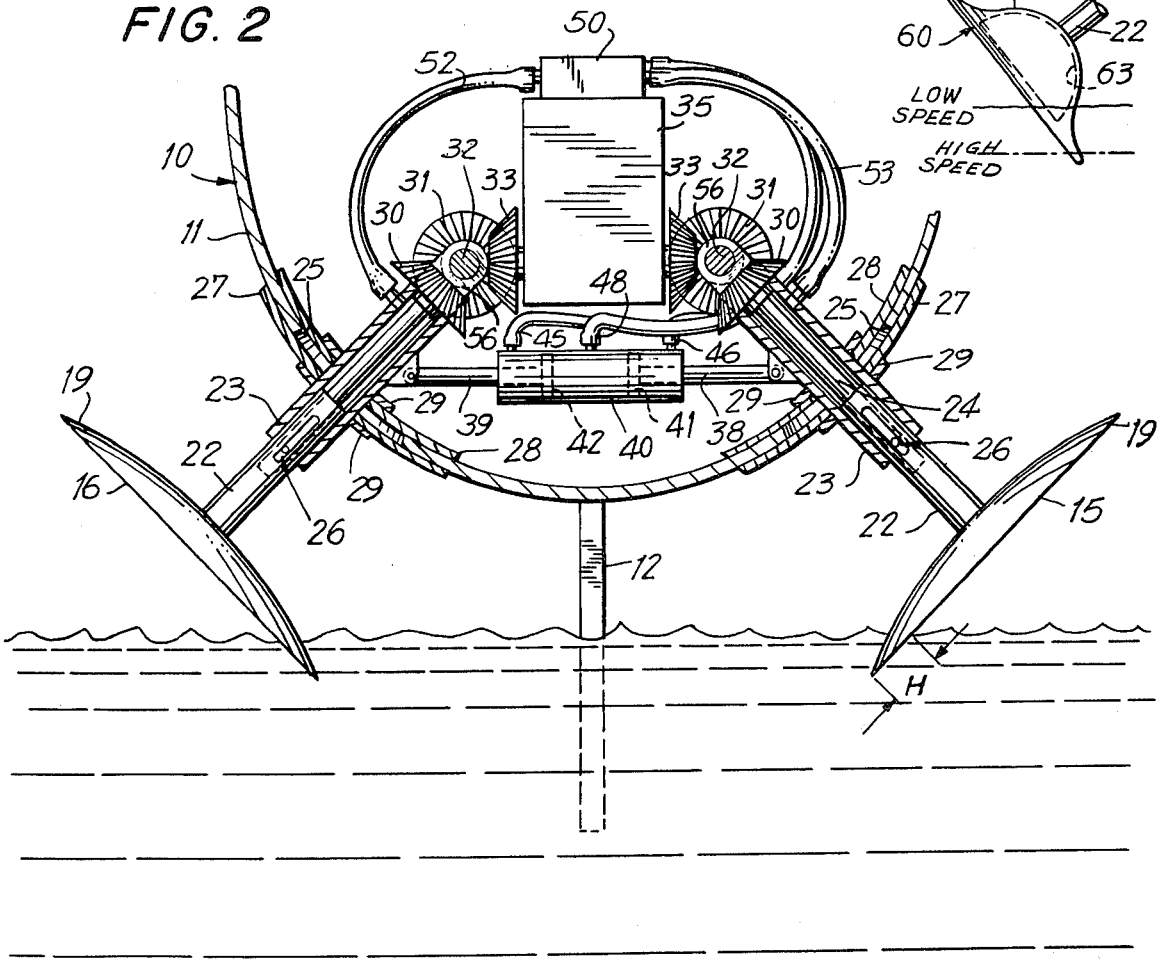
FIG. 2 is an enlarged fragmentary sectional view taken along the line 2—2 in FIG. 1.

FIG. **4*a* is a partially schematic fragmentary sectional view similar to FIG. 2** but illustrating a hydrofoil vessel in accordance with a further illustrative embodiment of the invention.

Figure 1:
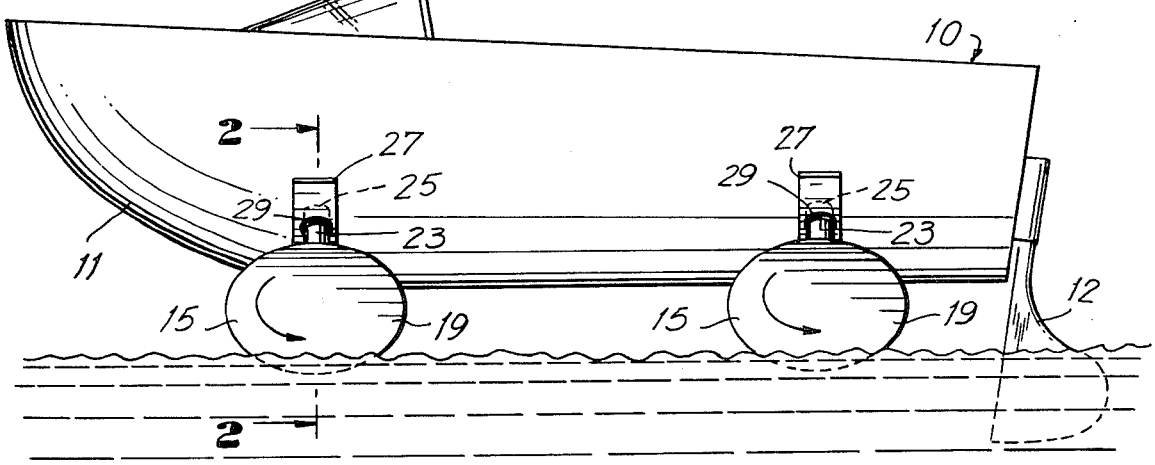
FIG. 1 is a partially schematic elevational view of a hydrofoil vessel in accordance with one illustrative embodiment of the invention.
Figure 4A:
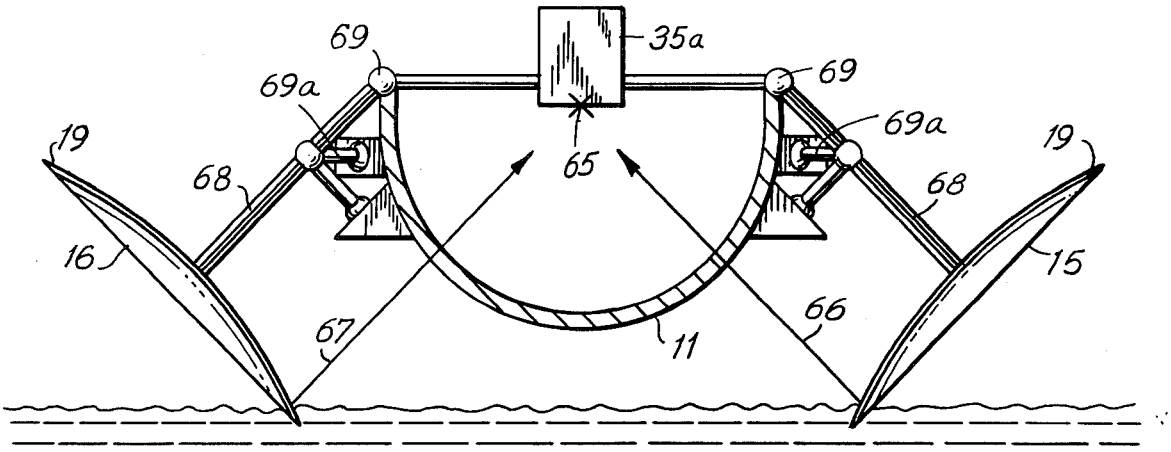

FIG. **4*b* is a partially schematic elevational view similar to FIG. 1 but illustrating the hydrofoil vessel shown in FIG. 4*a***.

Figure 4C:
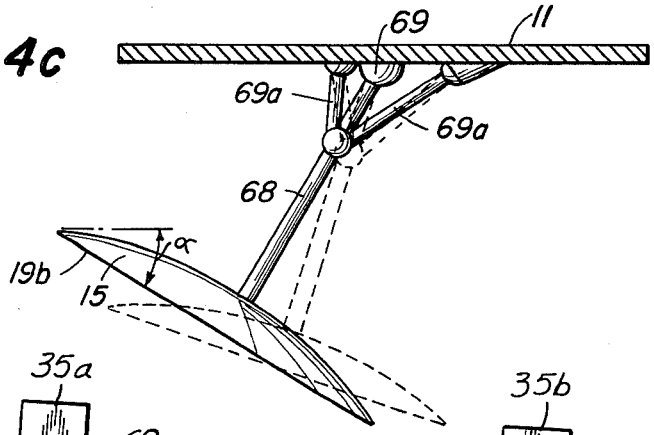
Figure 4B:
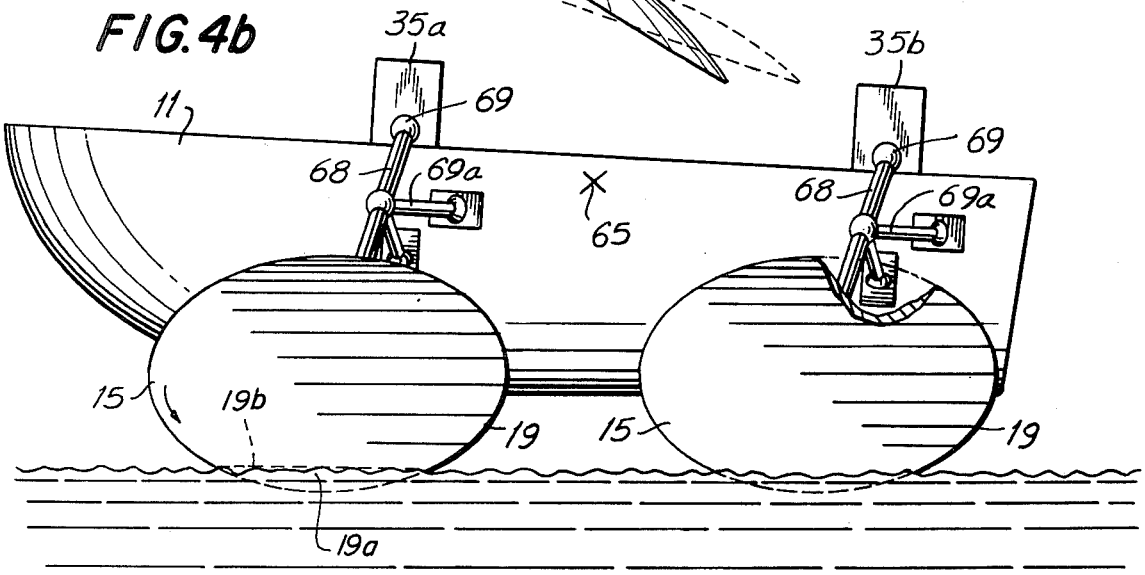

FIG. **4*c* is a partial top plan view of one side of the hydrofoil vessel as shown in FIG. 4*b*** adjacent one of the forward hydrofoil members.

FIG. **5*a*** is a schematic top plan view of a hydrofoil vessel in accordance with still another illustrative embodiment of the invention.

Figure 5A:
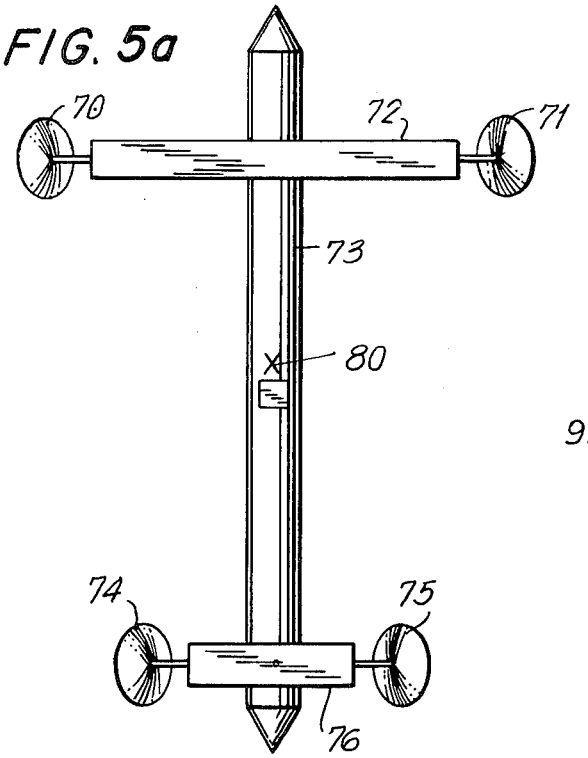

FIG. **5*b* is a schematic rear elevational view of the hydrofoil vessel shown in FIG. 5*a***.

FIG. **6*a*** is a schematic top plan view of a sailing craft hydrofoil vessel in accordance with a still further illustrative embodiment of the invention.

Figure 6A:
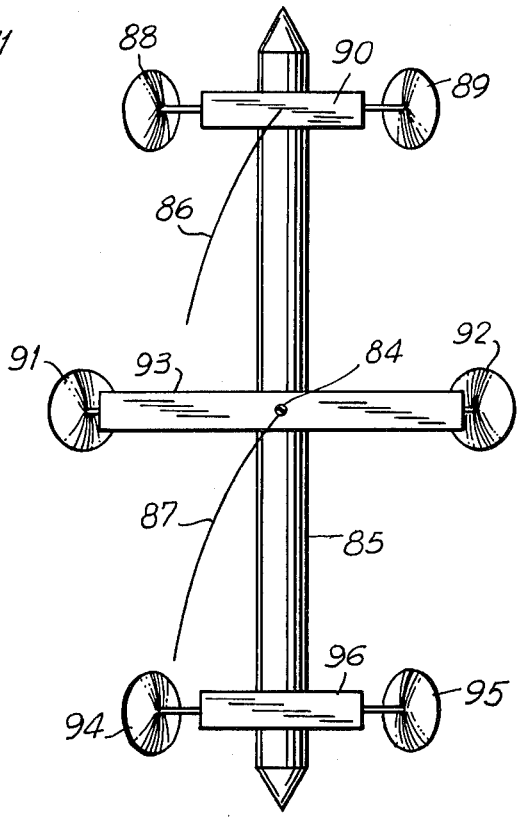

FIGS. **6*b*, 6*c* and 6*d* are schematic rear elevational views of the hydrofoil vessel shown in FIG. 6*a*** under varying wind conditions and with the hydrofoil elements in different positions.

FIG. **7*a*** is a schematic top plan view of a sailing craft hydrofoil vessel in accordance with another illustrative embodiment of the invention.

Figure 7A:
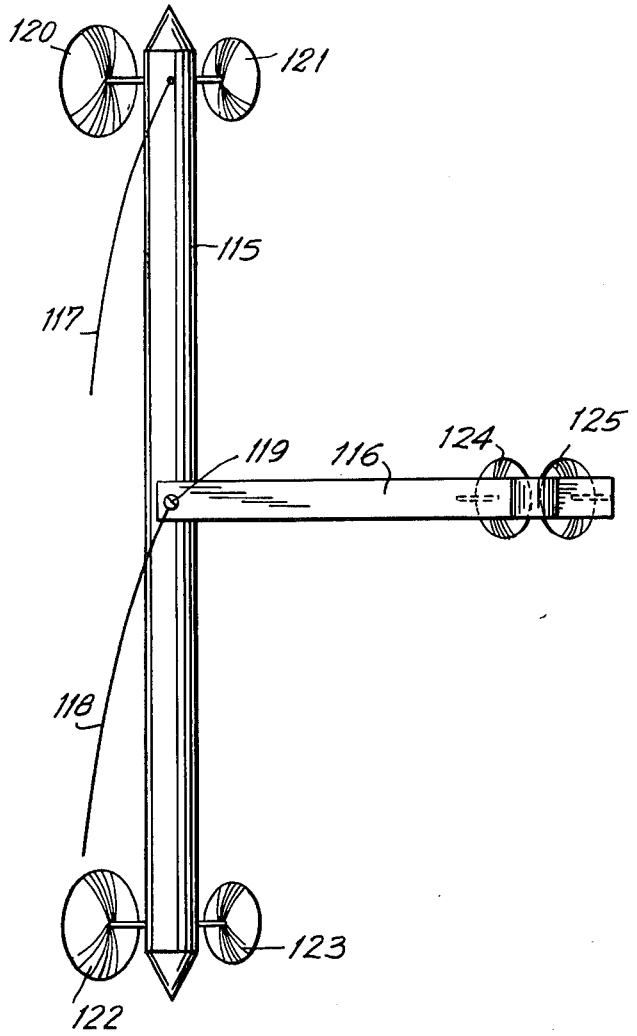
Figure 7B:
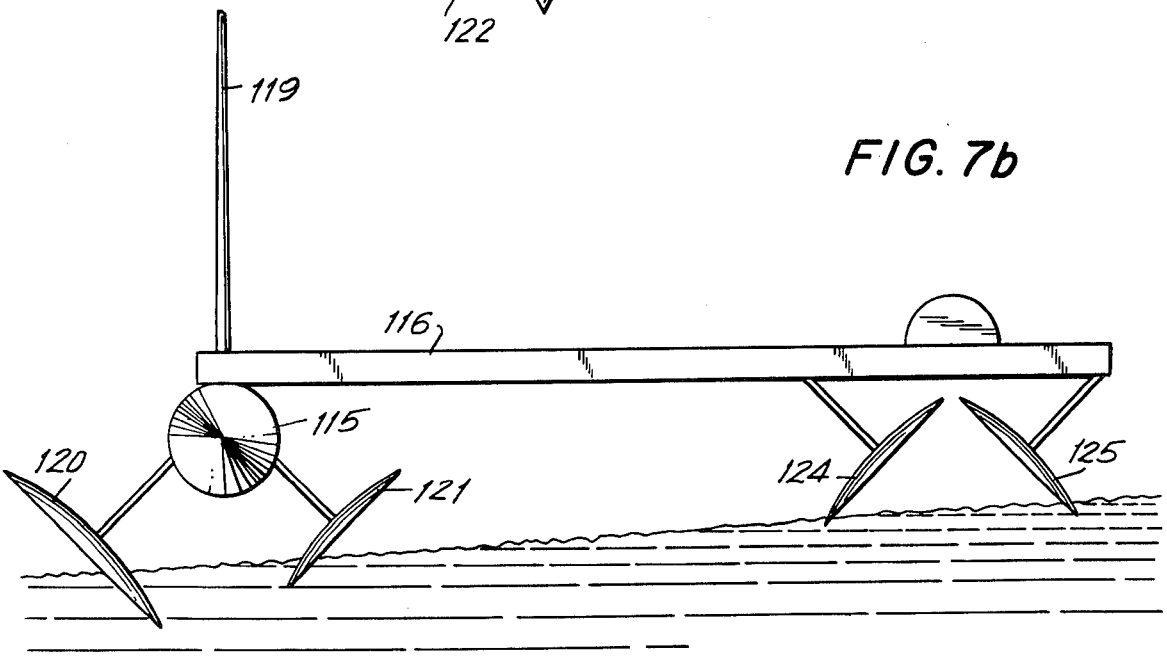

FIG. 7*b* is a schematic front view of the hydrofoil vessel shown in FIG. 7*a*.

DESCRIPTION OF CERTAIN PREFERRED EMBODIMENTS

Referring to FIG. 1 of the drawings, there is shown a vessel in the form of a boat 10 having a conventional hull 11 and a rudder 12. For purposes of illustration the boat 10 has been shown as an open cockpit power boat, but it will be understood that the invention also is applicable to both larger and smaller vessels including ocean going ships, sailboats, windmill powered boats, model or toy boats, etc.

Extending downwardly from the left or port side of the hull 11 are two disc-like hydrofoil members 15. Similarly, the starboard side of the hull is provided with two disc-like hydrofoil members 16. The members 15 and 16 are of circular configuration and are inclined in a downwardly inboard direction with respect to the hull such that their axes are inclined in a downwardly outboard direction. It is advantageous in many cases to orient the axes of rotation of the foil elements 15 and 16 such that at any given height above the plane of the water surface the distance between the forward edges of the foil elements is slightly less than the distance between the back edges. This "toe-in" serves to cause the foil elements to push against each other with a resultant upward force which provides additional lift for the hull 11.

Each of the members 15 and 16 illustratively is of fiberglass or other comparatively rigid material and has a cross-section in the shape of a shallow segment of a circle with the flat chord portion facing downwardly and the arcuate portion facing toward the hull. In other advantageous arrangements the members 15 and 16 are made from a flexible material such as reinforced rubber and depend on a combination of the stiffness of the material and centrifugal force to maintain their shape. The members 15 and 16 are arranged in forward and aft pairs, and the two members in each pair are in oppositely disposed relationship with each other.

Each of the circular members 15 and 16 is provided with a thin foil-shaped peripheral portion 19. As illustrated in the drawings and in particular in FIG. 1, the annular peripheral edge portion of the disc which defines foil 19 is substantially flat and has no portion thereof extending further inwardly of the member than a flat plane extending across the annular peripheral edge portion. The peripheral portion 19 extends into the water at an acute angle which is in the range of between about 10° and about 80° with respect to the water surface, and advantageously between about 30° and about 60°. The portion of the annular peripheral edge portion of the disc which extends into the water (i.e. the foil) defines a geometric segment, and the subtantially flat annular peripheral edge portion has a width that is at least as great as the height H of the geometric segment of the foil extending into the water so that the foil provides support for the vessel when operated at its higher speeds. For angles in excess of about 60° and hydrofoil effect diminishes rapidly, although between about 60° and about 80° the opposing lateral forces of the members substantially exceeds the vertical forces and this is useful mainly in situations where rapid maneuvering ability is a primary consideration. In cases in which the angle is much below 30° the full advantages of the invention are not achieved because of the frictional resistance of the peripheral portion as it moves through the water. In the illustrated embodiment the angle between the peripheral portion and the water surface is about 45°.

The circular members 15 and 16 are supported by axles or plungers 22 (FIG. 2). The plunger 22 for each member is rigidly affixed thereto and is inclined in a downwardly outboard direction with respect to the hull 11. A sleeve 23 extends from the hull in a similar direction and surrounds the upper portion of the plunger 22 in slidable relationship therewith. The plunger 22 also is rotatable relative to the sleeve 23, and the inner end of the plunger is connected to a rod 24 by a pin connection 26 of conventional configuration. The connection 26 serves to transmit rotary motion from the rod 24 to the sleeve 23 but permits the plunger to move in an axial direction relative to the rod for purposes that will become more fully aparent hereinafter.

The sleeves 23 for the circular members 15 and 16 extend through generally oblong openings 25 in the hull 11. Each of the openings 25 is closed by a sliding plate assembly which comprises an outer arcuate plate 27 and an inner arcuate plate 28. These plates are affixed to the sleeve 23 and are movable as a unit along the respective outer and inner surfaces of the hull. The arrangement is such that the plates 27 and 28, the sleeve 23, and rod 24, the plunger 22 and the corresponding circular member 15 or 16 are readily movable in an angularly upward or downward direction but are prevented from substantial movement in a fore and aft direction. Rotary movement of the sleeve 23 relative to the hull is prevented by suitable collars 29.

Mounted within the hull 11 on the inner end of each of the rods 24 is a bevel gear 30. The gear 30 is in meshing engagement with a second bevel gear 31 carried by an idler shaft 32. The gear 31 in turn meshes with a further gear 33 protruding from a drive mechanism shown schematically at 35. The mechanism 35 may comprise the power source for the vessel and serves to drive the gear 33 and thus rotate the corresponding circular member 15 or 16 by means of the interconnecting gear 31, the gear 30, the rod 24 and the plunger 22.

For best results the speed of rotation of the circular members 15 and 16 should be at least approximately equal to the linear speed of the peripheral portions 19 through the water. The direction of rotation is such that the circular members 15 are driven in the same direction as that of the circular members 16, that is, the members 15 and 16 all rotate in a counterclockwise direction as viewed from the port side of the vessel. With this arrangement, the segments of the peripheral portions 19 within the water move uniformly toward the stern.

Each pair of circular members 15 and 16 is interconnected by a control assembly within the hull 11. This assembly comprises two horizontal coaxial piston rods 38 and 39 respectively connected to the corresponding sleeves 23. The piston rods 38 and 39 extend into opposite ends of a cylinder 40 and are provided with pistons 41 and 42, respectively, within the cylinder.

Two fluid conduits 45 and 46 communicate with opposite ends of the cylinder 40, and an additional fluid conduit 48 communicates with the central portion of the cylinder. Each of the conduits 45, 46 and 48 leads to a control unit 50 which is powered by the drive mechanism 35 and may be either hydraulic or pneumatic in character. In a manner that will become more fully apparent hereinafter, the unit 50 provides variations in pressure within the conduits 45, 46 and 48 to control the angular positions of the circular members 15 and 16 with respect to the hull 11.

Also connected to the control unit 50 is an additional group of conduits 52 and 53. One of the conduits 52 and 53 is provided for each of the circular members 15 and 16, and each conduit communicates with the upper portion of the corresponding sleeve 23. The control unit is effective to adjust the pressure within the conduits 52 and 53, and hence within the sleeves 23, to move the plungers 22 and the attached circular members 15 and 16 toward or away from the hull 11. During this movement, the rods 24 remain axially stationary because of the sliding connection 26.

When the vessel is at rest the hull 11 provides the necessary buoyancy and support in the usual way. The driving power for the vessel may be supplied either by the circular members 15 and 16 or by a propeller or other conventional source of thrust. In cases in which the circular members 15 and 16 are used to provide driving power for the vessel, the drive mechanism 35 serves to rotate the members 15 and 16, and their rotary movement through the water supplies forward thrust. If a propeller, sail, rocket or other conventional power source is used, in some embodiments the action of the water on the peripheral portions 19 is sufficient to cause them to rotate at an appropriate speed, and additional thrust or friction reduction by the addition of the drive mechanism 35 will not be necessary. In other embodiments the additional thrust or friction reduction provided by the positive rotation of the members 15 and 16 is a very definite advantage.

Irrespective of the source of forward impetus, as the speed increases the hull 11 begins to rise at least partially out of the water, and at the higher speeds the hull is supported at least primarily by the peripheral portions 19 of the members 15 and 16. At the time the hull 11 reaches the position shown in FIG. 2, the vessel is in a planing condition with substantially the entire support being provided by the members 15 and 16.

Because of the rotary movement of the circular members 15 and 16, the relative speed between the peripheral portions 19 and the water is substantially reduced. The reduction in this relative speed provides a corresponding reduction in the frictional resistance or drag of the members 15 and 16, and the maximum speed of the vessel for a given power input is increased. The use of peripheral portions which are of thin, almost knifelike configuration enables the realization of the necessary support and at the same time leaves very narrow V-shaped wakes with minimum disturbance of the water.

In the positions shown in FIG. 2 the circular members 15 and 16 are maintained somewhat extended by fluid pressure supplied from the unit 50 to the corresponding control sleeves 23. Under some conditions, such as docking, narrow passages, certain conditions of speed, wind, waves, shallowness, etc., the members 15 and 16 may be readily retracted toward the hull 11 by reducing the pressure within the sleeves 23. The relative position between the members 15 and 16 on the one hand and the hull 11 on the other is adjustable in a rapid and straightforward manner in accordance with the wave action or other sea conditions to provide support for the vessel either by the members 15 and 16, by the hull 11, or by any combination of the two. In addition, by changing the extension of the forward pair of members relative to the back pair the pitch of the vessel may be controlled to vary the angle of attack of the peripheral portions.

In many situations it will be found useful to vary the extension of the circular foil members to maintain them at relatively constant depth in the water. Thus, as the members encounter waves they can be made to retract, and as they encounter troughs they can be caused to extend. This will aid both the smoothness of the ride and the stability and efficiency of the vessel. Such control may be actively caused in anticipation of or in response to waves by controlled variations in pressure in the sleeves 23 or by other means, but in many cases it will be sufficient to allow the increased axial lift which results from deeper immersion of the peripheral portions 19 to push the circular members closer to the hull 11 against appropriate springs (not shown), for example.

The angle at which the circular members 15 and 16 enter the water also is adjustable in accordance with sea conditions, forward speed or other factors. To accomplish this latter adjustment, the unit 50 is operated to either increase or decrease the pressure supplied to the cylinder 40 by the conduits 45 and 46, thus moving the circular members either toward one another or away from each other under the control of the piston rods 38 and 39.

The sleeves 23 are hung from U-shaped straps 56 which are loosely disposed around the corresponding idler shafts 32 and are rotatably connected to the faces of the bevel gears 30. The members 15 and 16 effectively pivot about the axes of the shafts 32 to change the angular disposition of the peripheral portions 19 relative to the surface of the water. During this movement, the sleeves 23 and their corresponding slide plates 27 and 28 are carried upwardly or downwardly relative to the hull 11 to orient the peripheral portions 19 at the desired angle.

Figure 3:
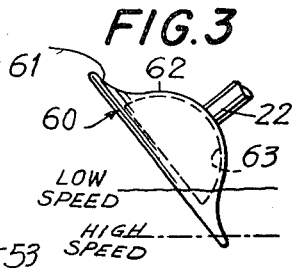
FIG. 3 is a partially schematic fragmentary view similar to a portion of FIG. 2 but illustrating a hydrofoil device in accordance with another illustrative embodiment of the invention.

FIG. 3 is illustrative of another preferred embodiment of the invention in which a disc-like circular member 60 is mounted on each of the plungers 22. The member 60 is oriented in a manner similar to the members 15 and 16 described heretofore and is inclined in a downwardly inboard direction with respect to the hull of the vessel such that its axis is inclined in a downwardly outboard direction. As in the previously described embodiment, the member 60 is provided with a thin hydrofoil-shaped peripheral portion 61 which extends into the water at an angle with respect to the water surface to provide support for the vessel when operated at its higher speeds.

The circular member 60 includes a center portion 62 which is substantially thicker than the center portions of the circular members 15 and 16 in the embodiment of FIGS. 1 and 2. The portion 62 is generally hollow to provide a buoyant chember 63.

When the vessel is operated at low speed, the chamber 63 provides substantial support by reason of its buoyancy. As the speed increases, the circular member 60 rises further out of the water, and at high speed the support is provided substantially entirely by the peripheral portion 61 in the manner described heretofore.

Good stability of hydrofoil craft of this type may be achieved by placing the circular foil elements 15 and 16 such that the force vectors they generate do not in sum produce movement about the center of gravity. The simplest way to achieve this is to arrange the foil elements in a downwardly inboard configuration, such that their force vectors, projected on a plane perpendicular to the direction of motion of the vessel, are aimed through the center of gravity. In FIGS. **4*a* and 4*b* there is shown a vessel with a hull 11, control mechanisms 35*a*** and 35*b*, and a center of gravity 65. The projected force vector 66 of the circular elements 15 and the projected force vector 67 of the circular elements 16 pass through the center of gravity 65.

The circular elements 15 and 16 on the vessel of FIGS. 4*a* and 4*b* are mounted on spindles 68 connected to the control mechanisms 35*a* and 35*b* by universal joints 69 so that a geometric segment 19*a* of the circular peripheral foil portion thereof extends into the water to support the vessel, as seen in FIG. 4*b*. This segment of the foil defines a chord 19*b* which, when the vessel is viewed in plan, defines an angle $\alpha$ with respect to the longitudinal axis of the hull, as seen in FIG. 4*c*. Control shafts 69*a* protrude through the hull 11 adjacent the spindles 68 and are suitably connected thereto to pivot the spindles in a fore and aft direction about the universal joints 69 to vary the angle $\alpha$ as indicated by the solid and dotted line positions of the circular element shown in FIG. 4*c*. With this arrangement, the chord defined by the segment of the annular peripheral foil portion extending into the water defines an angle in plan, with respect to the longitudinal axes of the hull and this angle may be varied so that the degree of "toe-in" or "toe-out" of the elements 15 and 16 may be readily and independently controlled in accordance with the speed of the vessel and varying conditions of sea and wind, and the vessel may be steered without the use of a rudder.

It is not necessary for each of the projected force vectors 66 and 67 to pass through the center of gravity 65 if their sum does not produce unwanted roll, yaw or pitch. For example, one pair of foil elements can have vectors which pass below the center of gravity, thereby tending to produce an outward rolling movement of the hull as the vessel rounds a curve, while the other pair of foil elements can have force vectors which are aimed above the center of gravity, thereby tending to produce an inward rolling movement on the hull. The two rolling movements offset one another, and good stability is achieved.

Figure 5B:
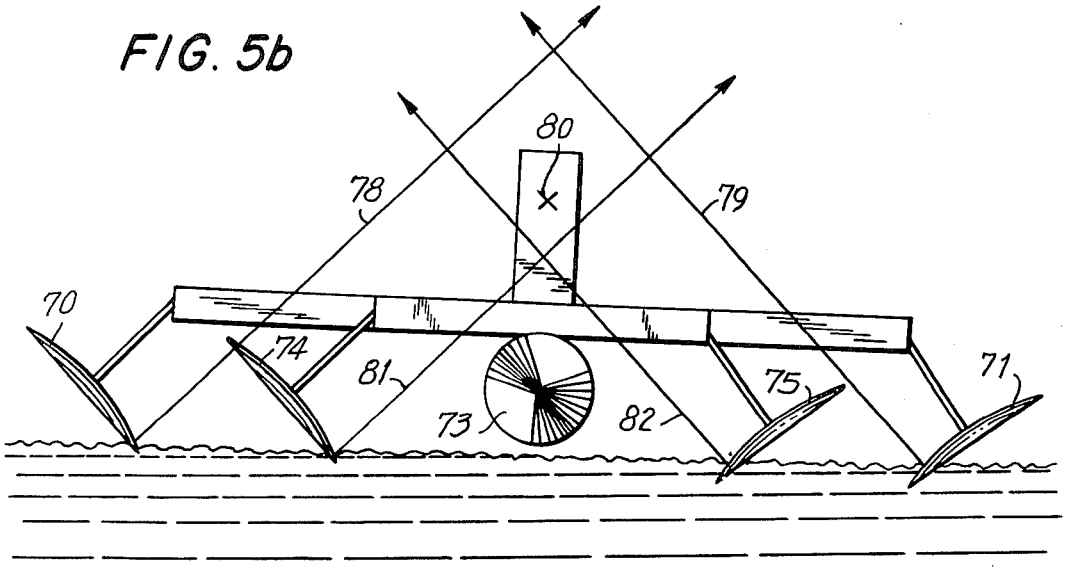

One such arrangement is illustrated in FIGS. 5*a* and 5*b*. The vessel of these Figures includes a front pair of circular foils 70 and 71 connected by a cross arm 72 to a body or hull portion 73 and a rear pair of circular foils 74 and 75 connected by a cross arm 76. This latter cross arm is pivotally affixed to the body portion 73 for movement about a vertical axis to produce a means for steering the vessel. As best shown in FIG. 5*b*, the vectors 78 and 79 for the foils 70 and 71 cross above the center of gravity 80, and the vectors 81 and 82 for the foils 74 and 75 cross below the center of gravity.

The systems illustrated in FIGS. 4, 5*a* and 5*b* automatically provide a degree of adjustment to shifts in the center of gravity. If the center of gravity is moved upward, the craft will have a tendency to roll out in turns and bury the outside circular foil elements. This burying tendency of the center of gravity shift is offset by the buoyancy of the foils, and by the fact that as the foils bury deeper the force vectors shift upward relative to the center of gravity.

Figure 6B:
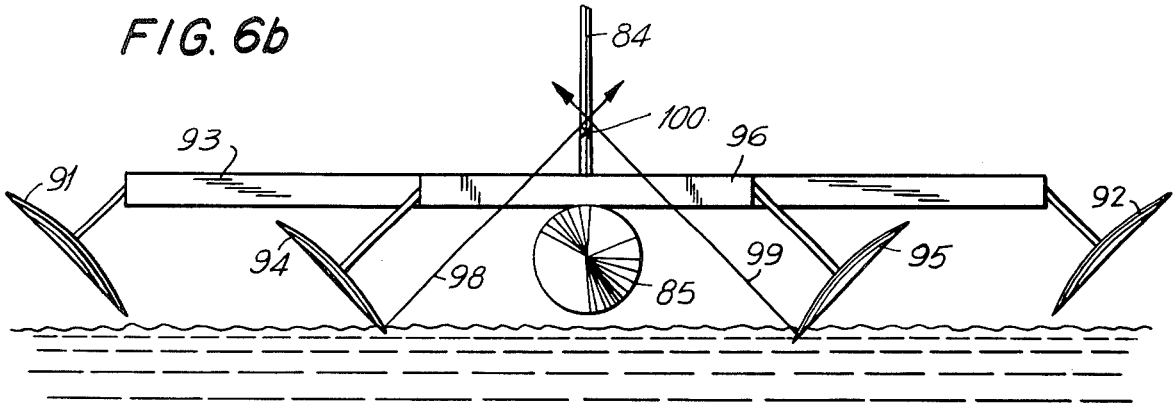
Figure 6C:
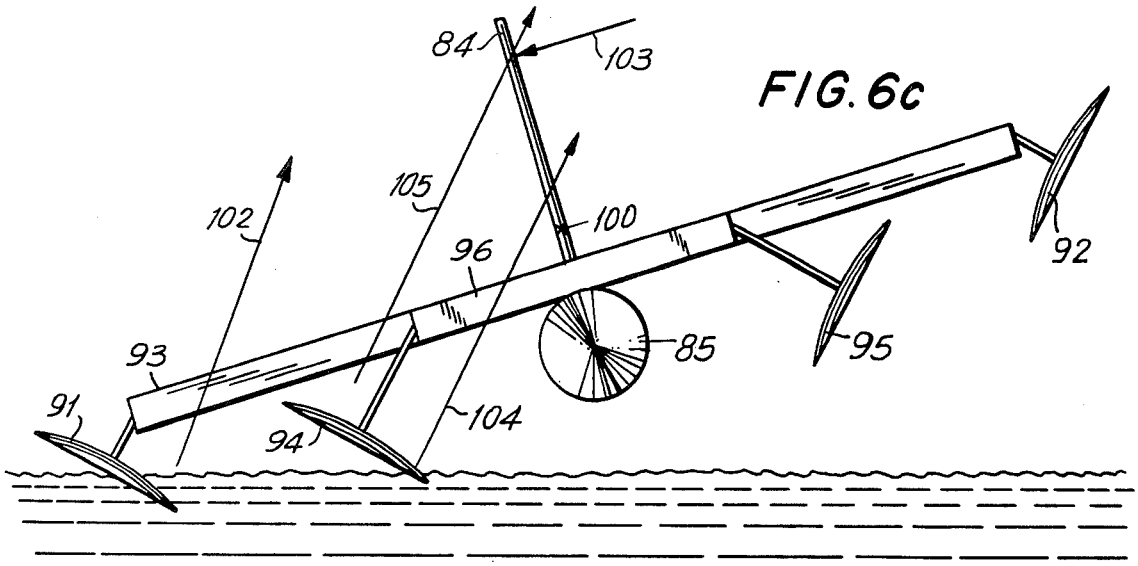

In sailing craft it will usually be found that the center of effort of the sail is high above the center of gravity of the vessel. As the loads which the foil system must off-set to keep the vessel upright shift between these two points, good roll stability is of particular importance. One configuration that does this is shown in FIGS. 6*a*–6*d*. The sailing hydrofoil vessel of these Figures includes a mast 84, a body portion 85 and fore and aft sails 86 and 87. A first pair of foil-shaped members 88 and 89 is supported from a cross bar 90 adjacent the bow of the vessel, a second pair of foil-shaped members 91 and 92 is suspended from a somewhat longer cross bar 93 adjacent the mast 84, and a third pair of foil-shaped members 94 and 95 is suspended from a cross bar 96 adjacent the stern. With the vessel in the upright position illustrated in FIG. 6*b*, the force vectors 98 and 99 for the bow and stern foils cross just about at the center of gravity 100. In FIG. 6*c*, with the vessel heeling under the force of the wind, the leeward outboard force vector 102 crosses above the center of the wind force 103, while the leeward inboard force vector 104 crosses below the center of the wind force. The arrangement is such that the resultant vector 105 passes through the center of wind force 103 and automatically stabilizes the craft.

Figure 6D:
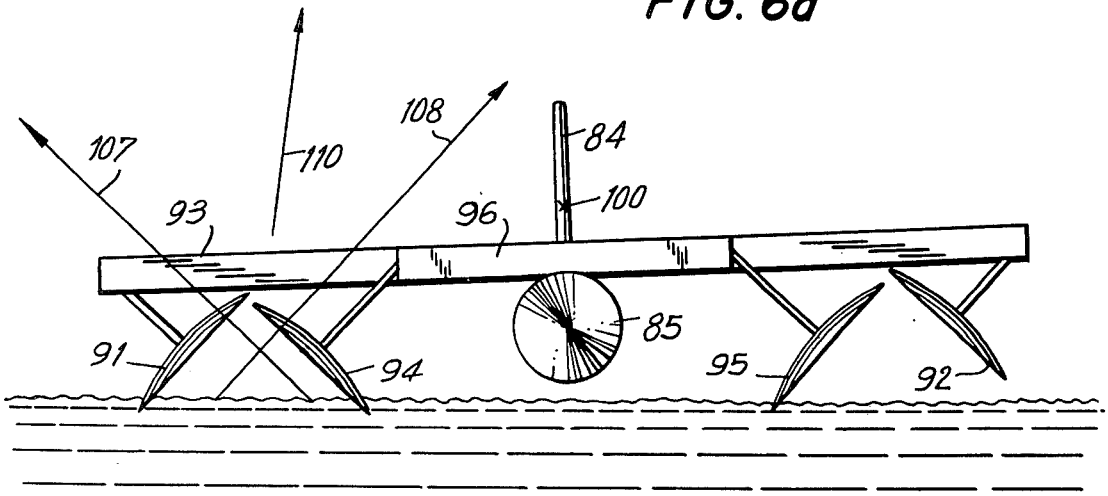

Even more rapid corrections for changes in the direction of the sum of the force vectors from the depressed side can be achieved by the use of circular foil elements with a downwardly outboard orientation in conjunction with foil elements of the downwardly inboard orientation. In FIG. 6*d*, for example, the outboard foils 91 and 92 are arranged in a downwardly outboard configuration, and the inboard foils 94 and 95 are arranged in a downwardly inboard configuration. The force vector 107 of the leeward outboard foil 91 points in an outboard direction, and the force vector 108 of the leeward inboard foil 94 points in an inboard direction. The resultant 110 of the two vectors swings upwardly rapidly as the foil 91 is forced deeper into the water; and in the illustration it is almost vertical. Consequently, as the vessel rolls the roll center rises until appropriate counter force is achieved and stability is maintained.

Another preferred embodiment which also exhibits good stability employs three close-set pairs of opposing foils at the three corners of a triangle. FIGS. 7*a* and 7*b* show such an arrangement. The vessel of these Figures has a hull or body portion 115, an outrigger 116, sails 117 and 118 and a mast 119. Respective pairs of foils 120, 121 and 122, 123 are suspended from adjacent the bow and stern of the body portion 115, and a third pair of foils 124, 125 is suspended from the outboard end of the outrigger 116. The foils in each pair are oppositely disposed with respect to one another, and the orientation of the outrigger foils is reversed with respect to the foils on the hull portion such that the outrigger foils have a downwardly outboard orientation relative to each other while the hull portion foils have a downwardly inboard orientation relative to each other. The hull portion foils 121 and 123 are somewhat smaller than the hull portion foils 120 and 122 and serve to regulate the depth at which these latter foils operate.

Although the hull or body portions of vessels in accordance with the invention may be of more or less conventional configuration, the invention is equally applicable to vessels having body portions of substantially any shape. In some cases, for example, particularly when the circular foil members are of the types shown in FIG. 3, the body portion may comprise little more than an open framework for supporting the circular members and the attendant drive and control mechanisms.

As has been stated earlier, in certain embodiments of this invention the hydrofoil vessel is propelled by the hydrofoils. In accordance with this feature of the invention, in many cases radially disposed fins (not shown) or other propelling structures are affixed to one or both surfaces of the circular foil members.

It, of course, will be apparent that the hydrofoil vessels of the present invention may readily be adapted for amphibious use. In some cases the circular foil-shaped members serve both as hydrodynamic lifting devices when the vessel is on the water and as wheels for propulsion and steering when on land. In other embodiments more conventional wheel structures may be substituted for the foils during land operation.

The terms and expressions which have been employed are used as terms of description and not of limitation, and there is no intention, in the use of such terms and expressions, of excluding any equivalents of the features shown and described or portions thereof, it being recognized that various modifications are possible within the scope of the invention.

What is claimed is:

1. A hydrofoil vessel comprising, in combination:
a body portion;
at least one pair of circular members supported on opposite sides of the body portion, each of the circular members having a thin foil shaped annular peripheral portion, said circular members being positioned at an angle with respect to the water surface with a geometric segment of said circular peripheral foil portion thereof extending into the water to support the vessel when operated at its higher speeds by virtue of the forward movement of the vessel;
said segment of the annular peripheral foil portion extending into the water defining a chord which, when said vessel is viewed in plan, defines an angle with the longitudinal axis of the body portion; and
mounting means for rotatably connecting the circular members of the body portion including means for varying the said angle between the longitudinal axis of the body portion and the chord of the immersed segment of said annular peripheral foil portion of the circular members.

2. A hydrofoil vessel comprising, in combination:
a body portion;
at least one pair of circular members supported on opposite sides of the body portion, each of the circular members having a thin foil shaped annular peripheral portion, the circular members being inclined in a downwardly inboard direction with respect to the body portion and their axes being inclined in a downwardly outboard direction, said circular members being positioned at an angle with respect to the water surface with a geometric segment of said circular peripheral foil portion thereof extending into the water to support the vessel when operated at its higher speeds by virtue of the forward movement of the vessel;
said segment of the annular peripheral foil portion extending into the water defining a chord which, when said vessel is viewed in plan, defines an angle with the longitudinal axis of the body portion; and
mounting means for rotatably connecting the circular members to the body portion including means for varying the said angle between the longitudinal axis of the body portion and the chord of the immersed segment of said annular peripheral foil portion of the circular members.

3. A hydrofoil vessel as defined in claim 2 in which the peripheral portion of each of the circular members extends into the water at an angle of between about 30° and 60° with respect to the water surface.

4. A hydrofoil vessel as defined in claim 1 including drive means for rotating the circular members to provide propulsion for the vessel.

5. A hydrofoil vessel as defined in claim 2 including drive means for rotating the circular members to provide propulsion for the vessel.

6. A hydrofoil vessel as defined in claim 1 in which the body portion is provided with a plurality of pairs of said circular members.

* * * * *